US011759062B1

(12) United States Patent
Fink

(10) Patent No.: US 11,759,062 B1
(45) Date of Patent: Sep. 19, 2023

(54) WET WIPE POCKET WITH DISPENSING MECHANISM

(71) Applicant: Edward Fink, New Port Richey, FL (US)

(72) Inventor: Edward Fink, New Port Richey, FL (US)

( * ) Notice: Subject to any disclaimer, the term of this patent is extended or adjusted under 35 U.S.C. 154(b) by 0 days.

(21) Appl. No.: 17/885,731

(22) Filed: Aug. 11, 2022

(51) Int. Cl.
*A47K 10/42* (2006.01)
*A47K 10/32* (2006.01)

(52) U.S. Cl.
CPC .... *A47K 10/421* (2013.01); *A47K 2010/3266* (2013.01); *A47K 2010/428* (2013.01)

(58) Field of Classification Search
CPC .... A47G 25/904; A47K 10/42; A47K 10/421; A47L 2010/428; A47L 2010/3266; B65H 3/0816
See application file for complete search history.

(56) References Cited

U.S. PATENT DOCUMENTS 939,148 A * 11/1909 Maxwell ..... B41L 1/24 462/19
1,507,707 A * 9/1924 Morganstern ..... A47L 13/18 D2/622
2,595,882 A * 5/1952 Pierce ..... A47K 7/03 401/7
D205,928 S * 10/1966 Rooker ..... D28/63
4,153,163 A * 5/1979 Aiderman ..... B65D 27/00 229/314
4,154,542 A * 5/1979 Rasmason ..... A47K 7/03 401/7
4,822,074 A * 4/1989 Hueffman ..... B42D 5/00 428/40.1
5,649,336 A * 7/1997 Finch ..... A47K 10/42 15/104.94
5,921,434 A * 7/1999 Hollander ..... A61B 42/40 221/34
10,092,932 B2 * 10/2018 Oster ..... B32B 29/00
10,166,088 B2 1/2019 Sachdeva et al.
10,870,527 B2 12/2020 Modha et al.
10,952,934 B1 * 3/2021 Fein ..... A61F 6/00
2003/0091466 A1 * 5/2003 Benko ..... A61L 9/04 422/123
2006/0049199 A1 * 3/2006 West ..... A61B 42/40 221/26

(Continued)

*Primary Examiner* — Gene O Crawford
*Assistant Examiner* — Kelvin L Randall, Jr.
(74) *Attorney, Agent, or Firm* — SANCHELIMA & ASSOCIATES, P.A.; Christian Sanchelima; Jesus Sanchelima

(57) ABSTRACT

A wet wipe pocket with dispensing mechanism including a pocket assembly and a dispenser assembly. The pocket assembly includes a plurality of pockets. Each pocket of the plurality of pockets has an opening. The opening receives the hand of a user therethrough. Each pocket of the plurality of pockets can cover the hand of a user. The. The plurality of pockets can be used to sanitize, disinfect, or clean. The dispenser assembly includes a dispensing element. The plurality of pockets are removable attached to a bottom and top portion of the dispensing elements. Each pocket of the plurality of pockets can be detached by pulling the pocket from the dispensing element. The plurality of pockets are used to disinfect the hand of a user or disinfect, wipe, and/or clean any surface.

4 Claims, 3 Drawing Sheets

(56) References Cited

U.S. PATENT DOCUMENTS

| | | | | |
|---|---|---|---|---|
| 2006/0237474 | A1* | 10/2006 | Long | B65D 83/0894 221/33 |
| 2012/0216329 | A1* | 8/2012 | Dennis | B65D 33/002 2/167 |
| 2012/0259455 | A1* | 10/2012 | Balkin | A47K 10/32 221/45 |
| 2019/0387932 | A1* | 12/2019 | Monsalve Cordova | A47K 10/426 |
| 2020/0138130 | A1* | 5/2020 | Harrison | A61B 42/50 |

* cited by examiner

WET WIPE POCKET WITH DISPENSING MECHANISM

BACKGROUND OF THE INVENTION

1. Field of the Invention

The present invention relates to a wet wipe pocket with dispensing mechanism and, more particularly, to a wet wipe pocket with dispensing mechanism that allows to fully cover the hand of a user with a detachable pocket, where the pocket is suitable to disinfect the hand of a user or disinfect, wipe, and/or clean any surface.

2. Description of the Related Art

Several designs for wipes have been designed in the past. None of them, however, include a plurality of disposable wipe pockets which can be used for cleaning anus and surrounding area while avoiding the hand of the user to get contaminated.

Applicant believes that a related reference corresponds to U.S. Pat. No. 10,166,088 issued for a disposable glove with a wipe portion which can be used for cleaning the rectal region. Applicant believes that another related reference corresponds to U.S. Pat. No. 10,870,527 issued for a dispensing assembly for a plurality of stacked gloves. None of these references, however, teach of a wet wipe pocket with dispensing mechanism that is comprised of a plurality of pocket members which have a wet wipe surface located on the palm portion which can be individually dispensed and donned from a storage container.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a wet wipe pocket with dispensing mechanism that includes a dispensing mechanism to dispense wiping elements through inserting the hand of a user in the wiping element and pulling.

It is another object of this invention to provide a wet wipe pocket with dispensing mechanism that includes a plurality of wiping elements made of a wiping material for assisting on cleaning the anus after defecation or any suitable surface.

It is still another object of the present invention to provide a wet wipe pocket with dispensing mechanism that includes a dispensing element which can store a plurality of wiping elements, where the wiping elements have the shape of a pocket.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
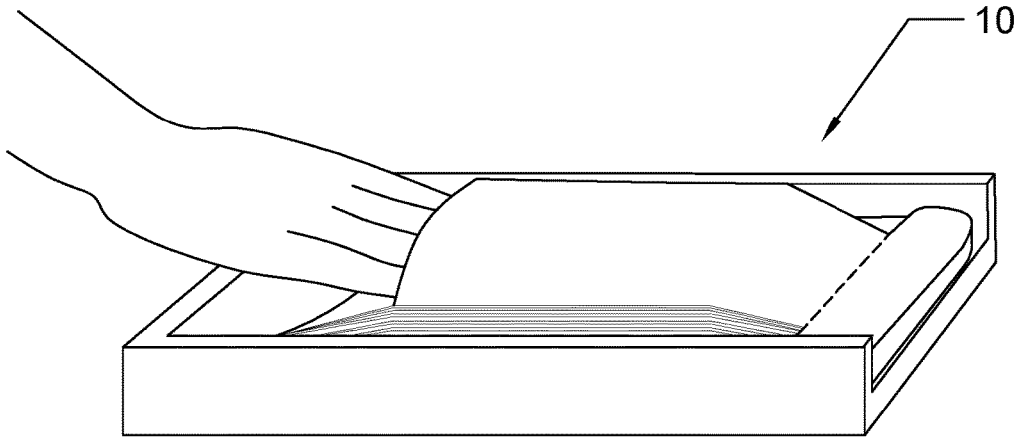
FIG. 1 represents an isometric operational view of the present invention 10 wherein a user introduces their hand to get the hand covered by a pocket of the plurality of pockets 22.
Figure 1A:
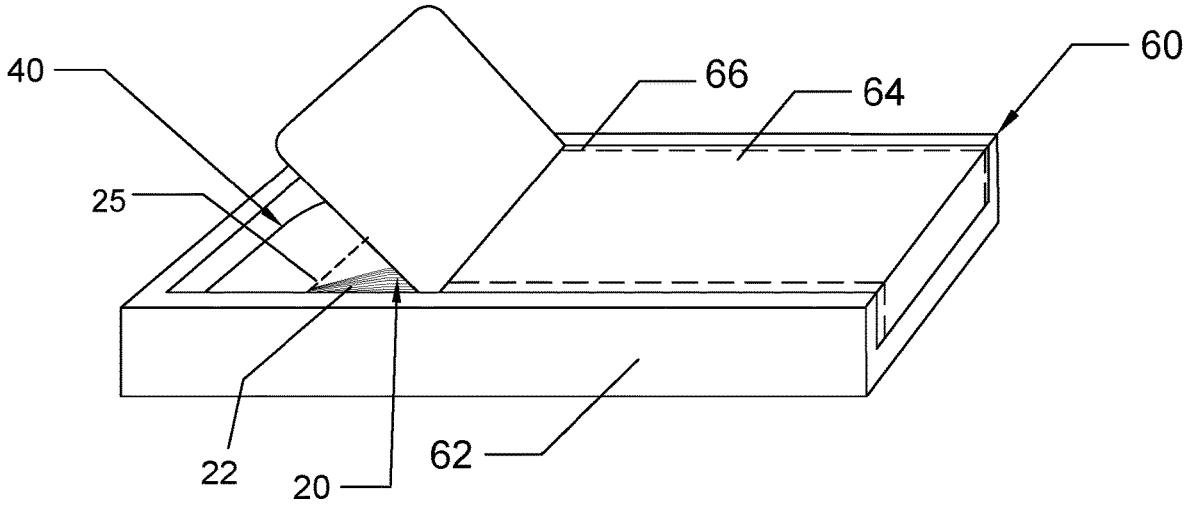
FIG. 1A depicts an isometric view of the present invention in a closed configuration.

Referring now to the drawings, where the present invention is generally referred to with numeral 10, it can be observed that it basically includes a pocket assembly 20, a dispenser assembly 40 and an enclosing assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The pocket assembly 20 may include a plurality of pockets 22 and crop lines 25. Each of the plurality of pockets 22 may be defined by a rear wall 24*a* and a front wall 24. The front wall 24 may be attached by its bottom, left and right edges to the bottom, left and right edges of the rear wall 24*a*. The front wall 24 and the rear wall 24*a* may be planar. The front wall 24 and the rear wall 24*a* may have a polygonal shape. The front wall 24 and the rear wall 24*a* may be made of nonwoven fabrics such as polyester or polypropylene. It also may be suitable for the front wall 24 and the rear wall 24 to be made of wood pulp, cotton, or any other suitable material. The rear wall 24*a* and the front wall 24 may be moistened in liquids, such as sanitizer, disinfectant, lotion, or perfume. It may be suitable for the rear wall 24*a* and the front wall 24 to include preservatives such as methylisothiazolinone to prevent bacterial or fungal growth thereon. In one embodiment the rear wall 24*a* may be larger in height than the front wall 24. The rear wall 24*a* and the front wall 24 may be attached together defining an opening 26 for each pocket of the plurality of pockets 22.

Each pocket of the plurality of pockets 22 may be hollow. Each of the plurality of pockets 22 may have such size and dimensions that allows a hand to fit therein. The plurality of pockets 22 may be detachable from the dispenser assembly 40. The plurality of pockets 22 may be disposable. The plurality of pockets 22 may have crop lines 25. In one embodiment the crop lines 25 are located in a bottom and top portion of each of the plurality of pockets 22. It also may be suitable for the crop lines 25 to be located on a left portion, on a right portion or have any other disposition in the plurality of pockets 22. The crop lines 25 may be near the junction of the at plurality of pockets 22 with the dispenser assembly 40. The crop lines 25 may be frangible dotted lines which allows to detach each of the plurality of pockets 22 from the dispenser assembly 40 by pulling each of the plurality of pockets 22 from the dispenser assembly 40. In a preferred embodiment one of the crop lines 25 may be located in the bottom junction of the rear wall 24*a* with the front wall 24 connecting the bottom of each of the plurality of pockets 22 to a bottom portion of the dispenser assembly 40. Another crop line of the crop lines 25 may be located in a top edge of the rear wall 24*a* connecting each of the plurality of pockets 22 to the dispenser assembly 40.

Figure 2:
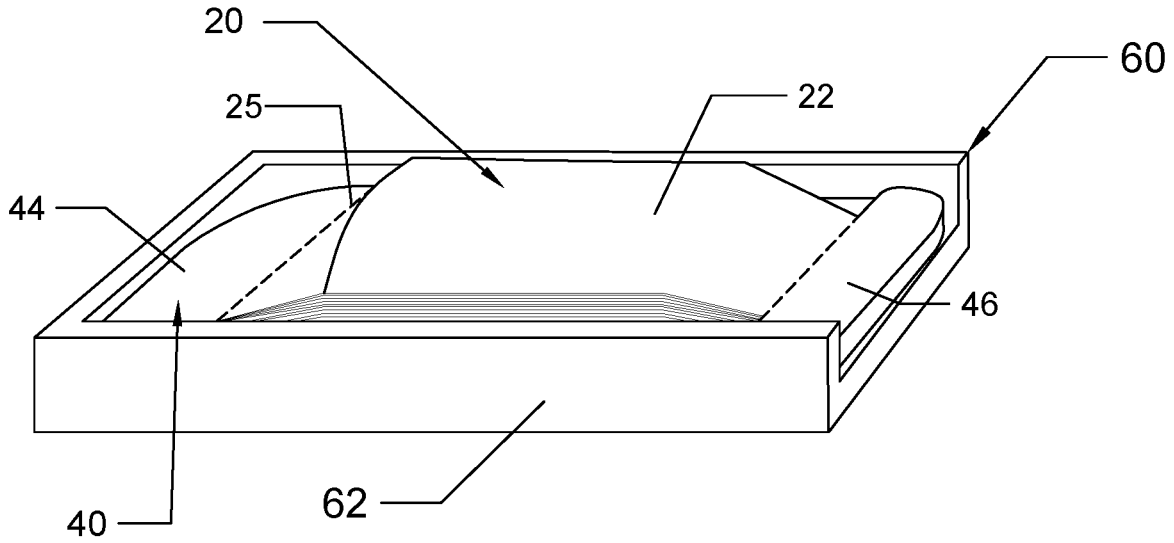
FIG. 2 shows an isometric view of the present invention 10 having the lid 64 removed.
Figure 3:
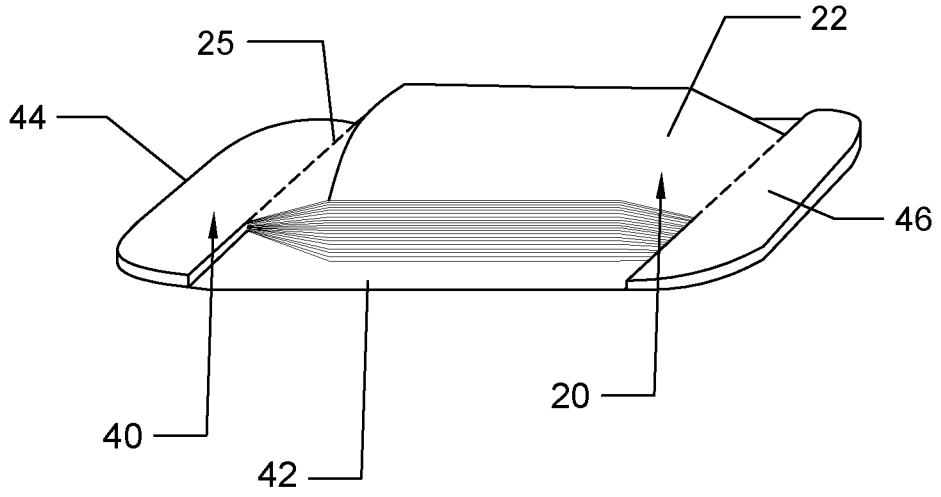
FIG. 3 illustrates a top view of the pocket assembly 20 and the dispenser assembly 40.
Figure 4:
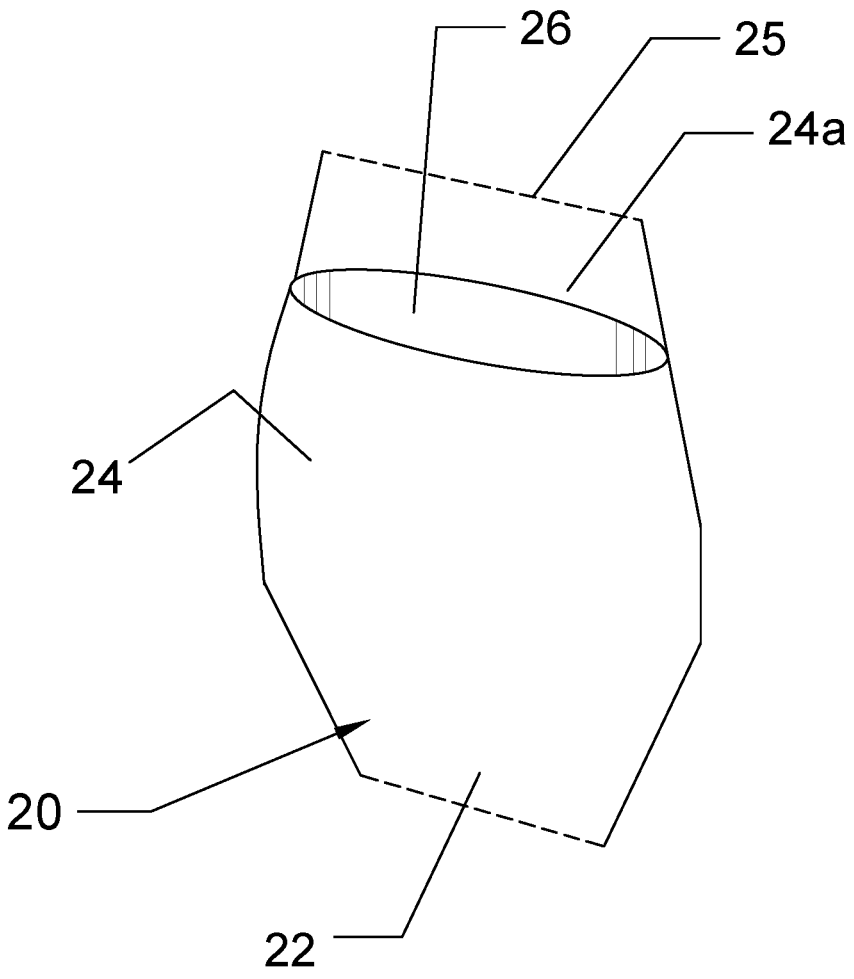
FIG. 4 is a representation of an enlarged view of the pocket assembly 20.

The dispenser assembly 40 may include a dispensing element 42, a top portion 44 and a bottom portion 46. The dispensing element 42 may have a polygonal shape. The dispensing element 42 may have a size that allows to place the plurality of pockets 22 thereover. The dispensing element 42 may be planar. The dispensing element 42 may be made of plastic, cardboard, or any other suitable material. The dispensing element 42 may include preservatives such as methylisothiazolinone to prevent bacterial or fungal growth thereon. The dispensing element 42 may be removable attached to the plurality of pockets 22. In a preferred embodiment as illustrated in FIG. 2 the plurality of pockets 22 may be removable from the dispensing element 42.

The top portion 44 may be a flap where a top portion of the plurality of pockets 22 is inserted. The bottom portion 46 may be a flap where a bottom portion of the plurality of pockets 22 is inserted. The top portion 44 and the bottom portion 46 may allow the plurality of pockets 22 to be attached to the dispenser assembly 40. The top portion 44 and the bottom portion 46 may have an elongated shape. The top portion 44 and the bottom portion 46 may extend by a top and bottom edge of the dispensing element 42. The top portion 44 and the bottom portion 46 may be made of the same material as the dispensing element. The top portion 44 and the bottom portion 46 may firmly keep the plurality of pockets 22 attached to the dispensing element 42.

In a preferred embodiment a user may introduce a hand through the opening 26 of one of the plurality of pockets 22 and pull to detach the one pocket of the plurality of pockets 22 from the dispensing element 42. The top and bottom of the plurality of pockets 22 may be removable attached to the top portion 46 and the bottom portion 44 of the dispensing element 42. For removal of the plurality of pockets 22 the crop lines 25 may tear when pulling the plurality of pockets 22 from the dispensing element 42. The user may use the detached pocket of the plurality of pockets 22 to sanitize or clean any surface. In a preferred embodiment a plurality of pockets 22 may be removable attached to the dispensing element 42. Thus, after detaching one of the plurality of pockets 22 from the dispensing element 42 a plurality of pockets 22 may be available underneath to be detached and used.

The enclosing assembly 60 may include a housing 62 and a lid 64. The lid 64 may be detachable from the housing 62. The housing 62 may be made of plastic, paper, metal, or any other suitable material. The housing 62 may have a rectangular shape. The housing 62 may have a bottom wall, a right wall, a left wall, a rear wall, and a front wall. The housing 62 may be hollow. The housing 62 may store the dispenser assembly 40 and the pocket assembly 20. The dispenser assembly 40 may be attached to the enclosing assembly 60. The bottom wall of the dispensing element 42 may be in abutting contact with the bottom wall of the housing 62. The top wall of the housing 62 may be defined by the lid 64. The lid 64 may be as wide as the container. The lid 64 may be made of plastic, metal, paper, or any other suitable material. The lid 64 may have crop lines 66. The lid 64 may have a rectangular shape. The crop lines 66 may tear when detaching the lid 64 from the housing 62. The crop lines 66 may define the edges of the lid 64. In a preferred embodiment the user may remove the lid 64 and detach one of the plurality of pockets 22 as needed. The plurality of pockets 22 may be stored in the enclosing assembly 60 to prevent the plurality of pockets 22 to get dry.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wet wipe pocket with dispensing mechanism, comprising:

a pocket assembly, wherein said pocket assembly includes a plurality of pockets, said plurality of pockets are made of wet wipes, wherein each of said plurality of pockets has a front wall and a rear wall, wherein said rear wall is larger in height than the height of said front wall, wherein said front wall and rear wall are connected defining an opening on each of said plurality of pockets, wherein a hand of a user is introduced through said opening, wherein each of said plurality of pockets are configured to cover the hand of a user, wherein said plurality of pockets include preservatives to prevent bacterial or fungal growth thereon, wherein said preservative is a methylisothiazolinone compound, wherein each of said plurality of pockets have an irregular convex elongated octagon shape;

a dispenser assembly, wherein said dispenser assembly includes a dispensing element, wherein said plurality of pockets are removable attached to said dispensing element, wherein each of said plurality of pockets is adapted to be pulled from said dispensing element to be detached thereof, wherein said dispensing element includes a top portion layer and a bottom portion layer extending transversely from the dispensing element and from one side of the dispensing element to another side of the dispensing element; said bottom portion and said top portion are connected by means of the dispensing element, wherein said plurality of pockets are stacked over said dispensing element, wherein each of said plurality of pockets have a top end removable attached to said top portion layer and a bottom end removable attached to said bottom portion layer, wherein each of said plurality of pockets include frangible crop lines on said bottom end and said top end, wherein said frangible crop lines are adapted to tear when pulling each of said plurality of pockets, wherein each of said plurality of pockets are held by means of said top portion layer and said bottom portion layer; and an enclosing assembly, wherein said enclosing assembly includes a housing, wherein said pocket assembly, and said dispenser assembly are stored in said housing, said housing is configured to protect said plurality of pockets from dust, said housing includes a lid, said lid is on the top of said housing, said lid is detachable, said lid is detached from said housing to access to said plurality of pockets.

2. The wet wipe pocket with dispensing mechanism set forth in claim 1, wherein said plurality of pockets are stacked one above the other, allowing said plurality of pockets to be detached one by one by means of said crop lines.

3. The wet wipe pocket with dispensing mechanism set forth in claim 1, wherein said plurality of pockets are disposable, said plurality of pockets are moistened with said preservative.

4. A wet wipe pocket with dispensing mechanism, consisting of:

a pocket assembly, wherein said pocket assembly includes a plurality of pockets, said plurality of pockets are made of wet wipes, wherein each of said plurality of pockets are configured to cover the hand of a user, wherein each of said plurality of pockets has a front wall and a rear wall, wherein said rear wall is larger in height than the height of said front wall, wherein said front wall and rear wall are connected defining an opening on a top portion of each of said plurality of pockets, wherein a hand of a user is introduced through said opening, said plurality of pockets include preservatives to prevent bacterial or fungal growth thereon, wherein said preservative is a methylisothiazolinone compound, wherein each of said plurality of pockets have an irregular convex octagon elongated shape;

a dispensing assembly, wherein said dispenser assembly includes a dispensing element, a top portion layer, and a bottom portion layer wherein said dispenser element has a polygonal shape with a bigger area than said plurality of pockets, said plurality of pockets are stacked one above the other over said dispensing element, wherein each of said plurality of pockets is adapted to be pulled from said dispensing element to be detached thereof, wherein said bottom portion layer and said top portion layer extend transversely from the dispensing element and from one side of the dispensing element to another side of the dispensing element, said bottom portion layer and said top portion layer being connected by means of the dispensing element, wherein said plurality of pockets are stacked over said dispensing element, wherein each of said plurality of pockets have a top end removable attached to said top portion layer and a bottom end removable attached to said bottom portion layer, wherein each of said plurality of pockets include frangible crop lines on said bottom end and said top end, wherein said frangible crop lines are adapted to tear when pulling each of said plurality of pockets, wherein each of said plurality of pockets are held by means of said top portion layer and said bottom portion layer, wherein said top portion layer is a mirror image of said bottom portion layer, wherein each of said top portion layer and said bottom portion layer have a height smaller than a height of the plurality of gloves stacked together;

an enclosing assembly, wherein said enclosing assembly includes a housing, wherein said pocket assembly, and said dispenser assembly are stored in said housing, said housing protects said plurality of pockets and said dispensing assembly from dust, said housing includes a lid, said lid is on the top of said housing, said lid is detachable by means of crop lines along a circumference thereof, said lid is detached by tearing said crop lines of said lid from said housing to access to said plurality of pockets.

* * * * *